US009472888B2

(12) United States Patent
Song et al.

(10) Patent No.: US 9,472,888 B2
(45) Date of Patent: Oct. 18, 2016

(54) CONNECTOR DEVICE AND ELECTRONIC DEVICE WITH THE SAME

(71) Applicant: Samsung Electronics Co., Ltd., Gyeonggi-do (KR)

(72) Inventors: Chan-Keun Song, Seoul (KR); Soon-Woong Yang, Gyeonggi-do (KR); Uy-Hyeon Jeong, Gyeonggi-do (KR)

(73) Assignee: Samsung Electronics Co., Ltd., Samsung-ro, Yeongtong-gu, Suwon-si, Gyeonggi-do (KR)

( * ) Notice: Subject to any disclaimer, the term of this patent is extended or adjusted under 35 U.S.C. 154(b) by 0 days.

(21) Appl. No.: 14/736,815

(22) Filed: Jun. 11, 2015

(65) Prior Publication Data

US 2015/0380862 A1 Dec. 31, 2015

(30) Foreign Application Priority Data

Jun. 27, 2014 (KR) ..... 10-2014-0079885

(51) Int. Cl.

| | |
|---|---|
| ***H01R 13/52*** | (2006.01) |
| ***H01R 12/70*** | (2011.01) |
| ***H01R 24/62*** | (2011.01) |
| ***H01R 13/74*** | (2006.01) |
| *H01R 12/72* | (2011.01) |

(52) U.S. Cl.

CPC ..... *H01R 13/5202* (2013.01); *H01R 12/7047* (2013.01); *H01R 13/521* (2013.01); *H01R 13/748* (2013.01); *H01R 24/62* (2013.01); *H01R 12/724* (2013.01)

(58) Field of Classification Search

CPC ..... H01R 13/5202; H01R 13/5219; H01R 13/6658

See application file for complete search history.

(56) References Cited

U.S. PATENT DOCUMENTS

| | | | | |
|---|---|---|---|---|
| 6,383,013 | B1 * | 5/2002 | Ghesla | G01D 11/24 439/408 |
| 6,511,329 | B2 * | 1/2003 | Yi-Tsung | H01R 13/52 439/701 |
| 6,767,225 | B1 | 7/2004 | Hwang | |
| 6,863,566 | B2 * | 3/2005 | Scheuerer | H01R 35/025 439/191 |
| 7,118,646 | B2 * | 10/2006 | Hunkeler | B60R 16/0239 156/293 |
| 7,413,445 | B2 * | 8/2008 | Inagaki | B60R 16/0239 439/76.1 |
| 7,736,158 | B2 * | 6/2010 | Yamaguchi | H05K 7/026 439/271 |
| 8,942,001 | B2 * | 1/2015 | Kawai | H05K 5/0052 174/50.5 |
| 8,979,554 | B2 * | 3/2015 | Yudate | H01R 13/5202 439/271 |
| 2001/0039130 | A1 * | 11/2001 | Nakamura | H01R 13/506 439/76.1 |
| 2002/0115344 | A1 * | 8/2002 | Chen | H01R 13/5219 439/587 |
| 2009/0130882 | A1 * | 5/2009 | Yamaguchi | H05K 7/026 439/271 |
| 2011/0300731 | A1 | 12/2011 | Nakamura | |
| 2014/0080329 | A1 * | 3/2014 | Yamanaka | H05K 5/0069 439/76.1 |
| 2014/0315439 | A1 | 10/2014 | Zhang | |

FOREIGN PATENT DOCUMENTS

CN 203288841 U 11/2013

* cited by examiner

*Primary Examiner* — Gary Paumen
(74) *Attorney, Agent, or Firm* — Cha & Reiter, LLC

(57) ABSTRACT

An electronic device may include a connector body that accommodates a connector terminal, and a sealing member provided in the connector body to seal a gap between the connector body and the electronic device.

22 Claims, 11 Drawing Sheets

110
150
130
210
220
300
210a
120
Z

CONNECTOR DEVICE AND ELECTRONIC DEVICE WITH THE SAME

CLAIM OF PRIORITY

This application claims the priority under 35 U.S.C. §119(a) to Korean Application Serial No. 10-2014-0079885, which was filed in the Korean Intellectual Property Office on Jun. 27, 2014, the entire content of which is hereby incorporated by reference.

BACKGROUND

1. Technical Field

The present disclosure generally relates to an electronic device having a connector device.

2. Description of the Related Art

An electronic device refers to a portable device that allows a user to access various digital content. The electronic device may include a portable terminal that enables transmission/reception to a device that allows the user to access various contents, such as an MP3 player, a PMP, and/or a wearable device, such as a smart watch or a Head Mounted Device (HMD), such as an eyeglass-type monitor.

Due to their portability, the above-mentioned electronic devices have been widely distributed to users and are used in various use environments regardless of time and place. In particular, recently, according to various leisure activities, the electronic devices are frequently exposed to various external environments. For example, the electronic devices are frequently placed in users' pockets or the like. Frequently, users carry the electronic devices even when they are in areas or environments that may be damaging to electronic devices, such as wet or hot environments (e.g., a health spa, a sauna, a washroom, or a lavatory). Users frequently carry their electronic devices when engaging in various outdoor activities that may be damaging to electronic equipment. For example, In the summer, users frequently carry the electronic devices even while enjoying outdoor activities, such as swimming or playing in the water. Also for example, in the winter, users frequently carry the electronic devices even while enjoying outdoor activities such as snowboarding or skiing.

SUMMARY

An electronic device may be provided with modules for enjoying various contents and also provided with connection devices so that the electronic device is connected with an external device so as to pair data with the external device, deliver a sound to the external device, or to receive a power from the external device, for example.

Among the connection devices, a connector, such as a USB, may be provided so that the electronic device can be connected with a separate external device. In general, such a connector device may be manufactured through SUS pressing. Conventionally, when a housing of the connector device manufactured through the SUS pressing, a hole is often formed due to an inner latch structure of an SUS press. The hole provides an access point through which foreign matter may easily infiltrate via the connector device. In addition, since the connector device is configured to be connected with the outside through a connector hole formed in the electronic device, a gap is formed between the connector device and the electronic device so that foreign matter may easily infiltrate through the gap.

In order to prevent the infiltration of foreign matter through the connector device and to implement dustproofing according to shaking or dropping of the electronic device, the electronic device may include a reinforcing device, such as a cover or a shield, that covers the connector device, in addition to the connector device.

A separate insert mold may be attached to the connector device in order to isolate the connector device from a case of the electronic device in which the connector device is inserted. When the separate insert mold is mounted on the connector device, a structure for waterproofing or dustproofing of the connector device may be implemented only when an additional attachment process is performed between the connector device and the insert mold.

According to an embodiment of the present disclosure, a connector device may inhibit or prevent infiltration of foreign matter to the inside of the connector device through, for example, the latch structure (e.g., hole) for installing the connector device. According to aspects of the present disclosure, an electronic device including a connector device may be provided to facilitate dustproofing, as well as, improved resistance to damage from drops or impacts according to dropping or an impact, and an electronic device may include the connector device.

In aspects of the present disclosure, a connector device may inhibit or prevent infiltration of foreign matter through a gap occurring between the connection device and a case of an electronic device when the connector device is mounted inside the case of the electronic device by sealing the gap between the connection device and the case, and an electronic device may include the connector device.

According to a further aspect of the present disclosure, a connector device may maintain rigidity despite frequent mounting of an external module without additionally assembling a structure, such as a cover or a shield can, to the connector device, and an electronic device including the connector device.

According to one embodiment of the present disclosure, a connector device may include: a connector body that accommodates a connector terminal; and a sealing member provided in the connector body to seal a gap between the connector body and an electronic device.

According to another embodiment of the present disclosure, there is provided with an electronic device provided with a connector device. The electronic device may include: a case of the electronic device; an opening provided in the case and formed as a single part; a body part, on which the connector terminal is mounted, the connector terminal being mounted inside the case, exposed outwardly through the opening, and connected with an external device; and a sealing member that seals a gap between the body part and the opening.

According to various embodiments of the present disclosure, in a connector device provided with a variable detection module and an electronic device including the connector device, a connector body that accommodates a connector terminal is formed through an MIM method. Thus, a gap, such as a hole, connected to the outside of a connector housing through an existing latch structure or the like, does not occur on the surface of the connector body, and thus, infiltration of foreign mater into the connector device can be prevented.

In addition, the body part of the connector device, which may be formed through the MIM method, may prevent or inhibit fracturing of the connector device when the connector is subjected to external impact or dropped, and can implement dustproofing even if a structure, such as a separate cover or a shield, is not additionally assembled around the body part. Further, the body part may maintain its rigidity even if an external module or device is frequently mounted.

When the connector device is mounted inside the case of the electronic device, the sealing member may seal the gap generated between the connection device and the case so that infiltration of foreign matter through the gap between the connection device and the case can be inhibited or prevented.

The guide member may be provided around the periphery of the body part. Thus, when the body part is mounted on the circuit board, the body part may be suppressed from moving, and may be prevented from being released, which may also facilitate assembly of the electronic device.

The circuit board may be cut out at a position corresponding to the position of the coupling part of the body part. Thus, when the body part is mounted on the circuit board, the circuit board may allow a fastening thickness to be reduced when the mounted body part is coupled to the case, and as a result, the electronic device can be slimmed.

The body part may be directly connected to a main circuit board provided inside the case. Otherwise, the circuit board may be provided in the case such that the circuit board is divided into first and second circuit boards, and the first and second circuit boards are electrically connected with each other through a separate connector. In particular, when the second circuit board, on which the body part is mounted, is provided to be electrically connected with the first circuit board after the circuit boards are provided to be separated from each other, fracturing of the body part or fracturing between the body part and the circuit boards can be prevented when the body part is assembled to the inside of the case, thereby facilitating assembly of the electronic device.

BRIEF DESCRIPTION OF THE DRAWINGS

The above and other aspects, features, and advantages of the present disclosure will be more apparent from the following detailed description taken in conjunction with the accompanying drawings, in which.

DETAILED DESCRIPTION

Figure 1:
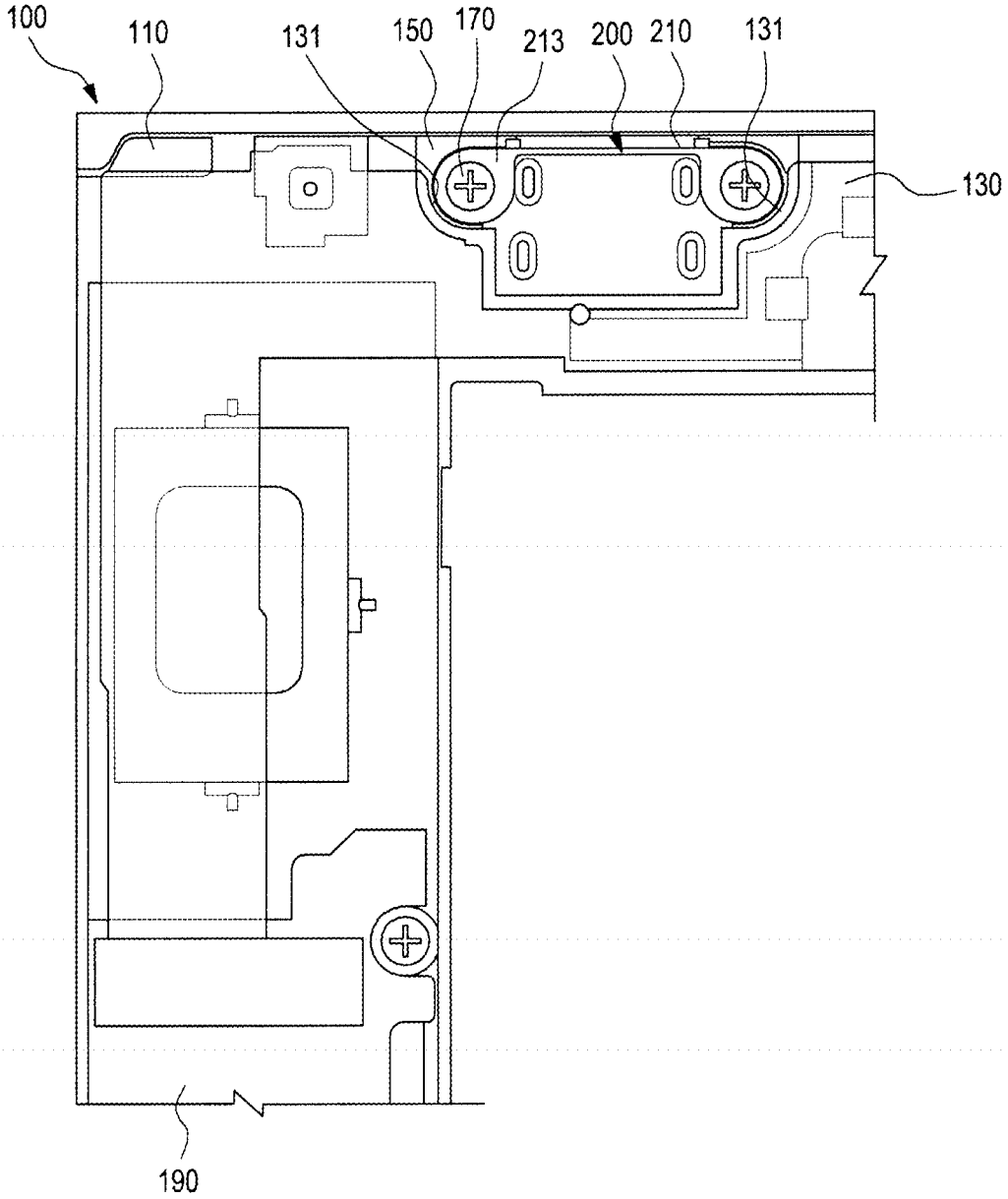
FIG. 1 is a top view illustrating an electronic device including a connector device according to one aspect among various aspects of the present disclosure.

Various embodiments of the present disclosure will be described with reference to the accompanying drawings. The present disclosure may have various embodiments, and modifications and changes may be made therein. Therefore, the present disclosure will be described in detail with reference to particular embodiments shown in the accompanying drawings. However, it should be understood that there is no intent to limit various embodiments of the present disclosure to the particular embodiments disclosed, but the present disclosure should be construed to cover all modifications, equivalents, and alternatives falling within the spirit and scope of the various embodiments of disclosure. In the description of the drawings, identical or similar reference numerals are used to designate identical or similar elements.

Hereinafter, the terms "include" or "may include", which may be used in various embodiments of the present disclosure, refer to the presence of disclosed functions, operations or elements, and do not restrict the addition of one or more functions, operations or elements. Further, as used in various embodiments of the present disclosure, the terms "include", "have", and their conjugates are intended merely to denote a certain feature, numeral, step, operation, element, component, or a combination thereof, and should not be construed to initially exclude the existence of or a possibility of addition of one or more other features, numerals, steps, operations, elements, components, or combinations thereof.

The term "or" in various embodiments of the disclosure means the inclusion of at least one or all of the disclosed elements. For example, the expression "A or B" may include A, may include B, or may include both A and B.

Expressions such as "first," "second," or the like used in various embodiments of the present disclosure may modify various component elements in the various embodiments but may not limit corresponding component elements. For example, the above expressions do not limit the sequence and/or importance of the elements. The expressions may be used to distinguish a component element from another component element. For example, a first user device and a second user device indicate different user devices although both of them are user devices. For example, a first constituent element may be termed a second constituent element, and likewise a second constituent element may also be termed a first constituent element without departing from the scope of various embodiments of the present disclosure.

It should be noted that if it is described that one component element is "coupled" or "connected" to another component element, the first component element may be directly coupled or connected to the second component or a third component element may be "coupled" or "connected" between the first and second component elements. Conversely, when one component element is "directly coupled" or "directly connected" to another component element, it may be construed that a third component element does not exist between the first component element and the second component element.

The terms as used in various embodiments of the present disclosure are merely for the purpose of describing particular embodiments and are not intended to limit the various embodiments of the present disclosure. As used herein, the singular forms are intended to include the plural forms as well, unless the context clearly indicates otherwise.

Unless defined otherwise, all terms used herein, including technical terms and scientific terms, have the same meaning as commonly understood by a person of ordinary skill in the art to which various embodiments of the present disclosure pertain. Such terms as those defined in a generally used dictionary are to be interpreted to have the meanings equal to the contextual meanings in the relevant field of art, and are not to be interpreted to have ideal or excessively formal meanings unless clearly defined in various embodiments of the present disclosure.

An electronic device according to various embodiments of the present disclosure may be a device having a function that is provided through various colors emitted depending on the states of the electronic device or a function of sensing a gesture or bio-signal. For example, the electronic device may include at least one of a smart phone, a tablet personal computer (PC), a mobile phone, a video phone, an e-book reader, a desktop PC, a laptop PC, a netbook computer, a personal digital assistant (PDA), a portable multimedia player (PMP), an MP3 player, a mobile medical device, a camera, a wearable device (e.g., a head-mounted-device (HMD) such as electronic glasses, electronic clothes, an electronic bracelet, an electronic necklace, an electronic appcessory (e.g., a smartphone accessory (e.g., a heart monitor, a credit card reader, etc.) that is controlled by the smartphone), an electronic tattoo, or a smart watch).

According to some embodiments, the electronic device may be a smart home appliance having a function serviced by light that emits various colors depending on the states of the electronic device or a function of sensing a gesture or bio-signal. The smart home appliance as an example of the electronic device may include at least one of, for example, a television, a Digital Video Disk (DVD) player, an audio, a refrigerator, an air conditioner, a vacuum cleaner, an oven, a microwave oven, a washing machine, an air cleaner, a set-top box, a TV box (e.g., Samsung HomeSync™, Apple TV™, or Google TV™), a game console, an electronic dictionary, an electronic key, a camcorder, and an electronic picture frame.

According to some embodiments, the electronic device may include at least one of various medical appliances (e.g., magnetic resonance angiography (MRA), magnetic resonance imaging (MRI), computed tomography (CT), and ultrasonic machines), navigation equipment, a global positioning system (GPS) receiver, an event data recorder (EDR), a flight data recorder (FDR), automotive infotainment device, electronic equipment for ships (e.g., ship navigation equipment and a gyrocompass), avionics, security equipment, a vehicle head unit, an industrial or home robot, an automatic teller machine (ATM) of a banking system, and a point of sales (POS) of a shop.

According to some embodiments, the electronic device may include at least one of a part of furniture or a building/structure, an electronic board, an electronic signature receiving device, a projector, and various kinds of measuring instruments (e.g., a water meter, an electric meter, a gas meter, and a radio wave meter), each of which has a function that is provided through various colors emitted depending on the states of the electronic device or a function of sensing a gesture or bio-signal. The electronic device according to various embodiments of the present disclosure may be a combination of one or more of the aforementioned various devices. Further, the electronic device according to various embodiments of the present disclosure may be a flexible device. Further, it will be apparent to those skilled in the art that the electronic device according to various embodiments of the present disclosure is not limited to the aforementioned devices.

Hereinafter, an electronic device according to the various embodiments will be described with reference to the accompanying drawings. In various embodiments, the term "user" may indicate a person using an electronic device or a device (e.g. an artificial intelligence electronic device) using an electronic device.

FIG. 1 is a top view illustrating an electronic device including a connector device according to an embodiment of the present disclosure.

Referring to FIG. 1, an electronic device 100 according to an embodiment of the present disclosure may be equipped with a connector device 200 which is capable of being connected to an external device (not illustrated). Specifically, the electronic device 100 according to an embodiment of the present disclosure may include a case 110, an opening 120 (as shown, for example, in FIGS. 4-5, 10A-B-C-11, 12A-B), a connector device 200, and a sealing member 300 (as shown, for example, in FIG. 3, 6).

The connector device 200 may be equipped within the electronic device 100, more specifically within the case 110, and may be provided to be connected to the outside of the case 110. An external device may be connected to the connector device 200 through the case 110.

Figure 2:
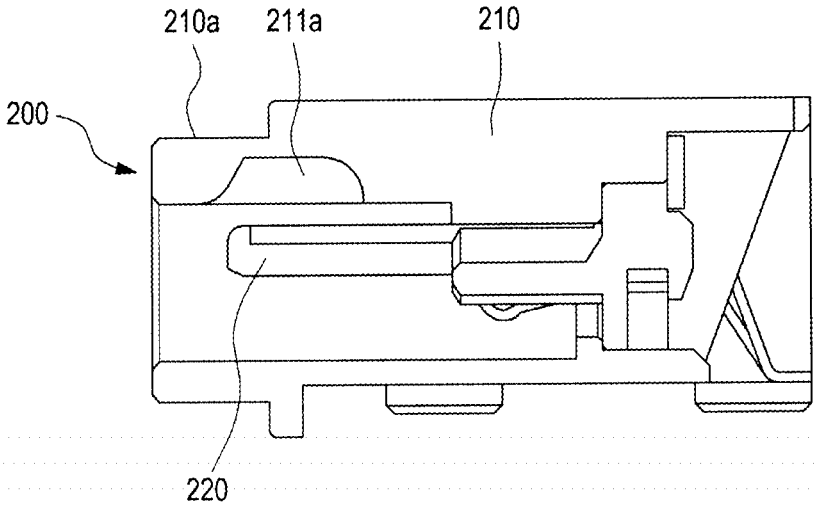
FIG. 2 is a cross-sectional view of a connector device according to one embodiment of the present disclosure in an electronic device including the connector device.
Figure 3:
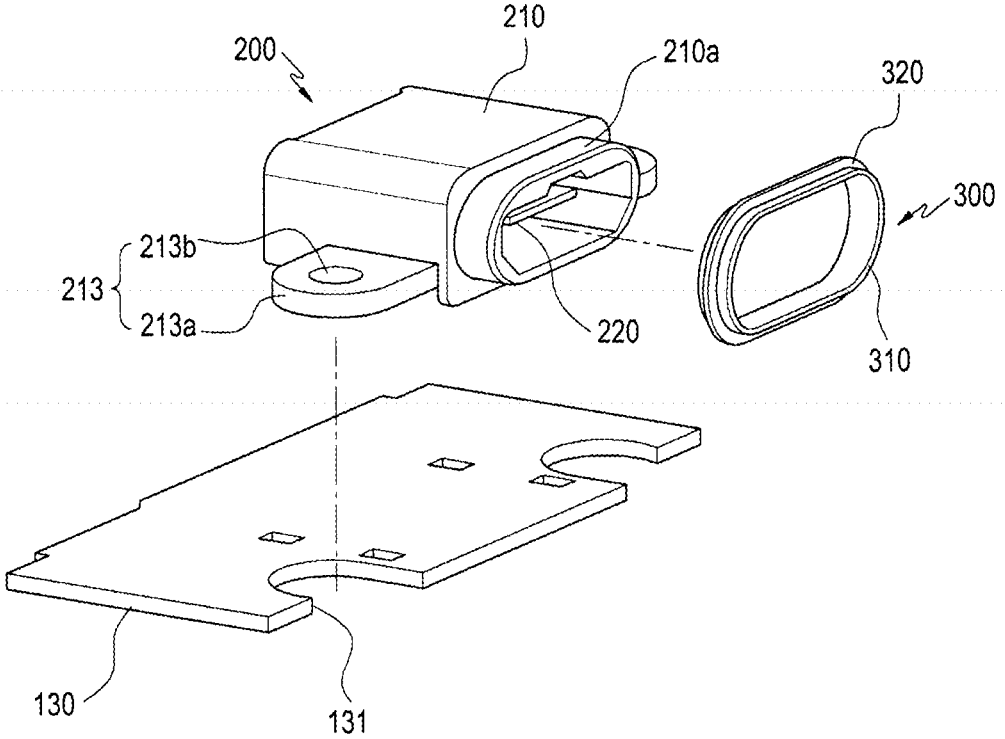
FIG. 3 is a perspective view illustrating a connector device according to an embodiment of the present disclosure in an electronic device including the connector device shown with parts separated.

FIG. 2 is a view illustrating a cross section of a connector device according to one embodiment among various embodiments of the present disclosure in an electronic device including the connector device. FIG. 3 is a perspective view illustrating a connector device of an electronic device according to an embodiment of the present shown with a sealing member separated from the connector device.

Referring to FIGS. 2 and 3, a connector device 200 according to one embodiment among various embodiments of the present disclosure may include a body part 210 (hereinafter, referred to as a "connector body") and a connector device 220. The connector body 210 may be equipped with the connector device 220 which is electrically connected with an external device (not illustrated).

The connector body 210 according to one embodiment among various embodiments of the present disclosure may be formed in one piece through Metal Injection Molding ("MIM"). Since the connector body 210 may be formed through the MIM, the connector body 210 may be formed without a hole or a gap on a surface of the connector body 210. One connector terminal 220 may be accommodated in an inner space of the connector body 210, or two connector devices 220 having different shapes may be accommodated in the inner space of the connector body 210. As described above, as the connector body 210 may be manufactured through the MIM, the connector body 210 may be provided as one piece.

Since the connector body 210 may be formed through the MIM, the connector device 220 may be accommodated by one connector body 210, fastened to the case 110, and reinforced even if the external device is frequently detached/attached. Thus, in the prior art, a stacking thickness increases due to a housing, in which a connector terminal is accommodated, and a structure for isolation from a case, such as a mold. Whereas, the connector device 200 according to one embodiment of the present disclosure is capable of implementing all the functions described above with one connector body 210, the connector device 200 may be implemented to be slimmed in the entire thickness, and an electronic device 100 equipped with the connector device 200 can also be implemented to be slimed in the entire thickness. In addition, during the MIM, the shape or thickness of the connector body 210 may be adjusted so that a predetermined level of rigidity can be implemented only with the connector body 210. The term "one piece" used herein may also be referred to as an integral type and may mean one body or one mass, of which the portions are not separated from each other.

Although it is described that the connector body 210 according to one embodiment of the present disclosure is molded as one piece by way of an example, the present disclosure is not limited thereto. For example, the connector body 210 may be manufactured to have a shape or a structure which is equipped with a connector terminal 220 therein and covered without a gap on the surface thereof through various methods, such as casting, welding, lathe processing, die casting, and mold processing. An end rim of the connector body 210 may be formed to be stepped. When the end of the connector body 210 is formed to be stepped, a sealing space of a sealing member 300 to be described later may be formed. In addition, when the sealing member 300 is mounted on the connector body 210, it may be possible to suppress the thickness of the peripheral portion of the connector body from increasing by the sealing member 300.

However, although depicted in one embodiment of the present disclosure that one end of the connector body 210 is stepped so as to form a space in which the sealing member 300 is mounted, the present disclosure is not limited thereto. That is, the end shape of the connector body 210 may be freely changed according to, for example, the shape of a gap between the connector body 210 and the opening 120. On the outer face of the connector body 210, specifically on the outer face of connector body 210, a coupling part 213 may be formed to protrude as one piece with the connector body 210 to be coupled with the case 110. According to one embodiment of the present disclosure, coupling parts 213 may protrude on opposite side faces in a direction horizontal to one face of connector body 210. The coupling part 213 may be provided with the case 110 to be described below in two different shapes according to the shape of fastening parts 140. The details of the coupling part 213 will be described together with the fastening parts 140 when the fastening parts 140 are described.

As described above, the sealing member (sealing part) 300 may be provided around one end of the connector body 210, specifically around a sealing face 210*a*. The sealing member 300 may seal a gap generated between the one end of the connector body 210 to be described below and the opening 120. In the embodiments of the present disclosure, sealing members 300 according to two embodiments may be described.

Figure 4:
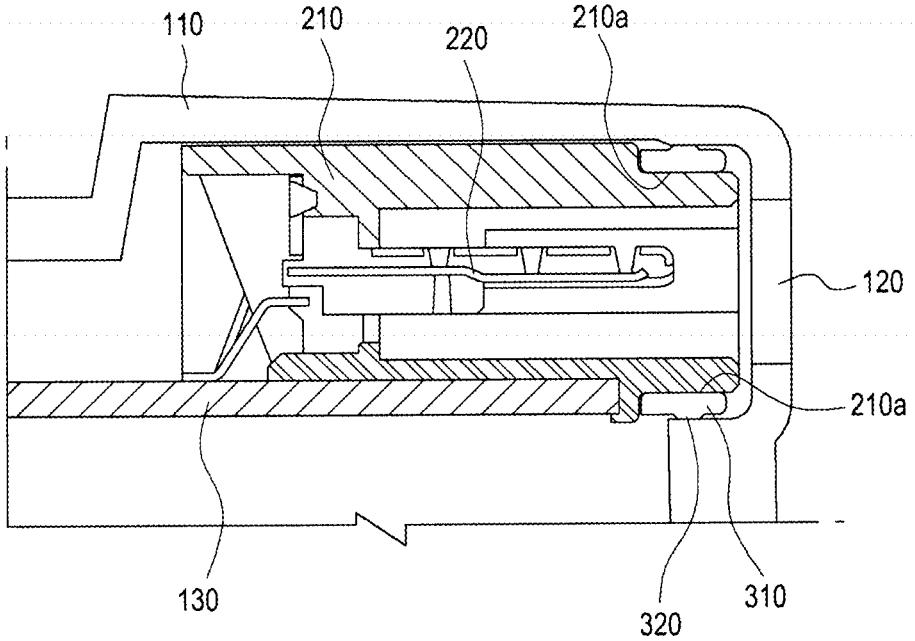
FIG. 4 is a view illustrating an embodiment of a sealing member in an electronic device including a connector device according to an embodiment of the present disclosure.

FIG. 4 is a view illustrating a first embodiment of a sealing member in an electronic device including a connector device according to one embodiment among various embodiments of the present disclosure.

Referring to FIG. 4, according to one embodiment among various embodiments of the present disclosure, a sealing member 300 may be made of an elastic material, such as rubber or silicon, and may include an attachment member 310, and a close contact member 320 (see also FIG. 3). The attachment member 310 is a component which is in close contact with a sealing face 210*a* while enclosing the sealing face 210*a*. The close contact member 320 is a component protruding along a surface of the attachment member 310 and is provided to be in close contact with the inner face of the opening 120. When one end of the connector body 210 is inserted into the opening 120, the close contact member 320 may be elastically in close contact with the inner face of the opening 120 to be capable of sealing a gap between the opening 120 and the connector body 210.

Figure 5:
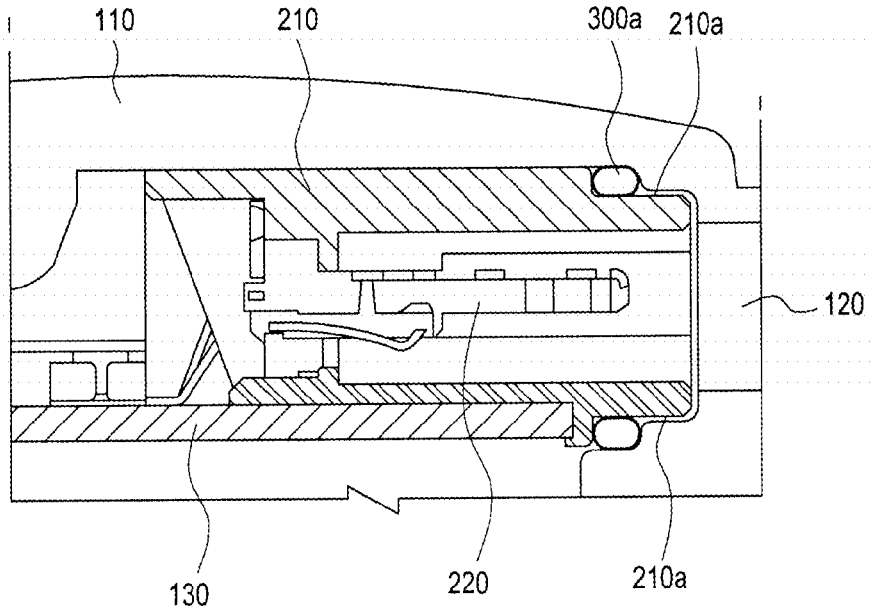
FIG. 5 is a view illustrating another embodiment of a sealing member in an electronic device including a connector device according to an embodiment of the present disclosure.
Figure 6:
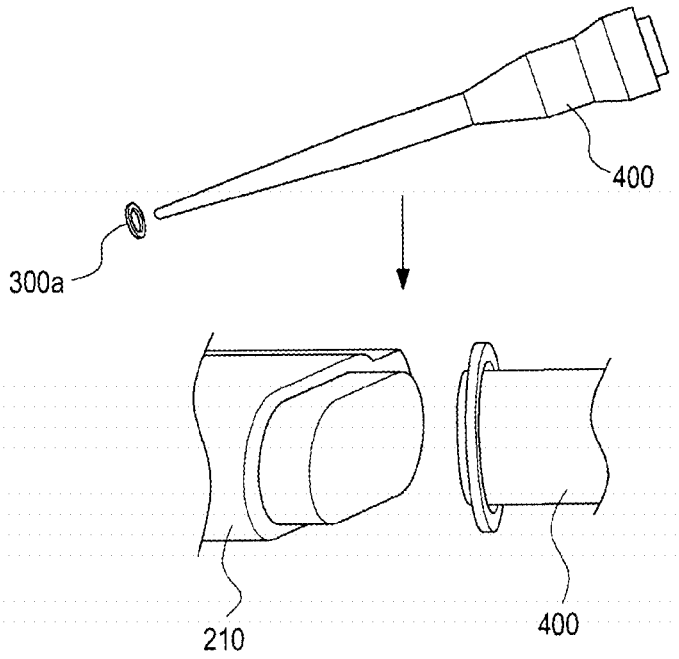
FIG. 6 illustrates embodiment showing a sealing member being mounted on a connector body in an electronic device including a connector device according to an embodiment of the present disclosure.
Figure 7:
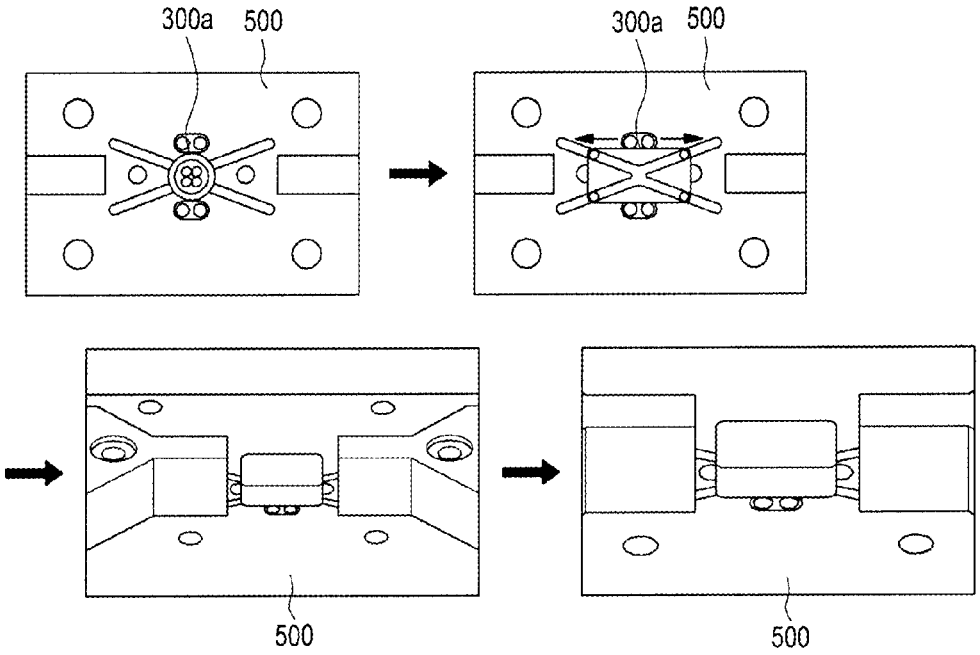
FIG. 7 illustrates an embodiment of a method of mounting a sealing member on a connector body in an electronic device including a connector device according to an embodiment of the present disclosure.

FIG. 5 is a view illustrating a second embodiment of a sealing member in an electronic device including a connector device according to one embodiment of the present disclosure. FIG. 6 illustrates one embodiment that mounts a sealing member on a connector body in an electronic device including a connector device according to one embodiment of the present disclosure. FIG. 7 illustrates another embodiment that mounts a sealing member on a connector body in an electronic device including a connector device according to one embodiment of the present disclosure.

Referring to FIG. 5, according to another embodiment among various embodiments of the present disclosure, the sealing member 300 may be formed as an O-ring 300*a* of an elastic material. The O-ring 300*a* may be tensioned by a separate jig and then seated on the sealing face 210*a*. When the end of the connector body 210 is seated in the opening 120, the O-ring 300*a* elastically comes in close contact between the sealing face 210*a* and the opening 120 to seal a gap.

As described above, a separate jig may be used in order to fasten the O-ring 300*a* to the sealing face 210*a*. In the present disclosure, two embodiments for fastening the O-ring to the sealing face may be described.

First, as illustrated in FIG. 6, the O-ring 300*a* may be mounted on the sealing face 210*a* using an auxiliary jig 400, which may have a tapered shape in which its size generally increases from one end toward the other end. The other end of the auxiliary jig 400 may have a shape which is the same as that of the sealing face 210*a*. Thus, when the O-ring 300*a* is fitted on the end of the auxiliary jig 400 which has the smallest diameter, and then the O-ring 300*a* is moved to the other end of the auxiliary jig 400, the size of the O-ring 300*a* is increased elastically, and tensioned to a size to be seated on the sealing face 210*a* at the other end of the auxiliary jig 400. When the O-ring 300*a* is moved in a state where the other end of the auxiliary jig 400 is abutted against the sealing face 210*a*, the O-ring 300*a* may be moved from the other end of the auxiliary jig 400 to the sealing face 210*a* to be mounted on the sealing face 210*a*.

On the contrary, as illustrated in FIG. 7, the O-ring 300*a* may be mounted on the sealing face 210*a* through an ejector pin 500. That is, when the ejector pin 500 is driven after the O-ring 300*a* is fitted on the ejector pin 500, the size of the O-ring 300*a* is elastically tensioned. When one end of the connector body 210 is inserted into the O-ring 300*a* which is tensioned such that the sealing face 210*a* can be inserted into the O-ring 300*a*, the O-ring 300*a* may be seated on and fastened to the sealing face 210*a*.

Figure 8:
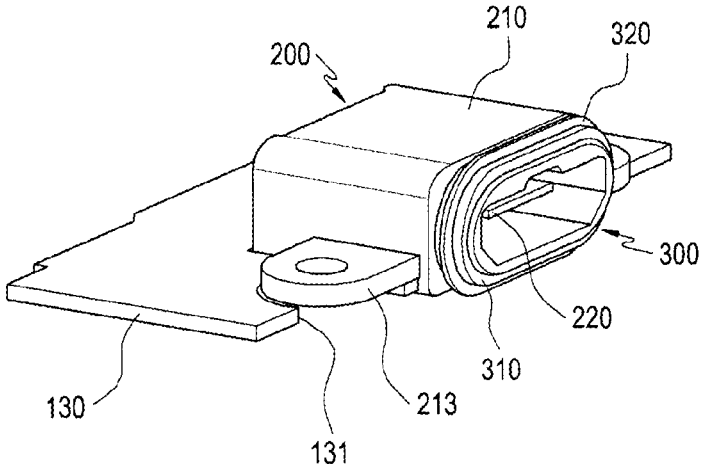
FIG. 8 is a perspective view illustrating a connector device, a sealing member, and a circuit board in an assembled state in an electronic device including a connector device according to an embodiment of the present disclosure.

FIG. 8 is a perspective view illustrating a connector device, a sealing member, and a circuit board in an assembled state in an electronic device including a connector device according to one embodiment of the present disclosure.

Referring to FIG. 8, one face of the connector body 210 provided as described above may be mounted to be electrically connected to the circuit board 130 mounted within the case 110 of the electronic device 100.

According to one embodiment among various embodiments of the present disclosure, the circuit board, to which the body part is electrically connected, may have two embodiments.

In one embodiment, the circuit board 130 may be a main circuit board mounted within the case 110. That is, the case 110 may be provided with one main circuit board on which various modules are mounted, and the connector body 210 may be directly mounted on the main circuit board 130. When the connector body 210 is directly mounted on the main circuit board 130, the number of assembly processes may be reduced.

In another embodiment, a first circuit board 190 may be provided within the case 110, the connector body 210 may be mounted on a separate circuit board (hereinafter, referred to as a "second circuit board 130"), and then, the second circuit board 130 may be electrically connected with the first circuit board 190 (see also FIG. 1). In this case, the second circuit board 130 may be electrically connected to the first circuit board 190 in a connector-to-connector (CON TO CON) type or in a ZIP type.

In the case of a method in which the connector body 210 is provided on the second circuit board 130 to be assembled to the first circuit board 190, when the connector body 210 is seated in the seating recess 111 of the case 110 to be described below (see FIG. 12*a*), the connector body 210 can be easily assembled. That is, the connector body 210, to which the second circuit board 130 is coupled, is inserted into the seating recess 111, and then the second circuit board 130 is electrically connected with the first circuit board 190 in the CON TO CON type or in the ZIP type. When the connector body 210 is provided to be connected with the first circuit board 190 through the second circuit board 130, fracturing of the connector device 100, fracturing of the main circuit board 190 or the auxiliary circuit board 130, or fracturing between the connector body 210 and the first circuit board 190 or the second circuit board 130, which may be caused at the time of assembly, may be prevented and the assembly can be facilitated. In addition, only the connector body 210 equipped with the second circuit board 130 may be separately configured so that the coupling reliability or reliability for electrical connection between the connector body 210 and the second circuit board 130 can be improved.

The circuit board 130, on which the connector body 210 is mounted as described above (hereinafter, the second circuit board or the main circuit board to which the connector body is coupled will be generally called a "circuit board") may be formed with cutout portions 131 at the positions corresponding to the coupling parts 213. When the circuit board 130 is stacked and mounted on one face of the connector body 210, the circuit board 130 is not stacked on the coupling part 213. Thus, a fastening height may be offset between the coupling part 213 and the fastening part 140 by the height of the circuit board 130 so that the electronic device 100 may be implemented to be slimmed in the entire thickness.

Figure 9:
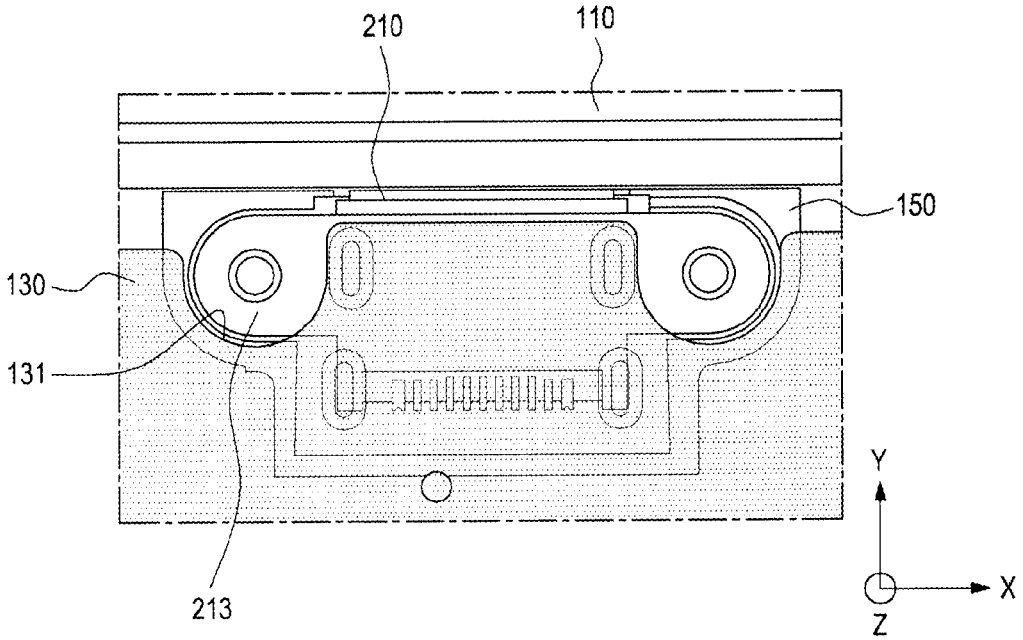
FIG. 9 is a view illustrating a state where a guide member is provided along a coupling line of a connector body and a circuit board in an electronic device including a connector device according to an embodiment of the present disclosure.
Figures 10A, 10B, 10C:
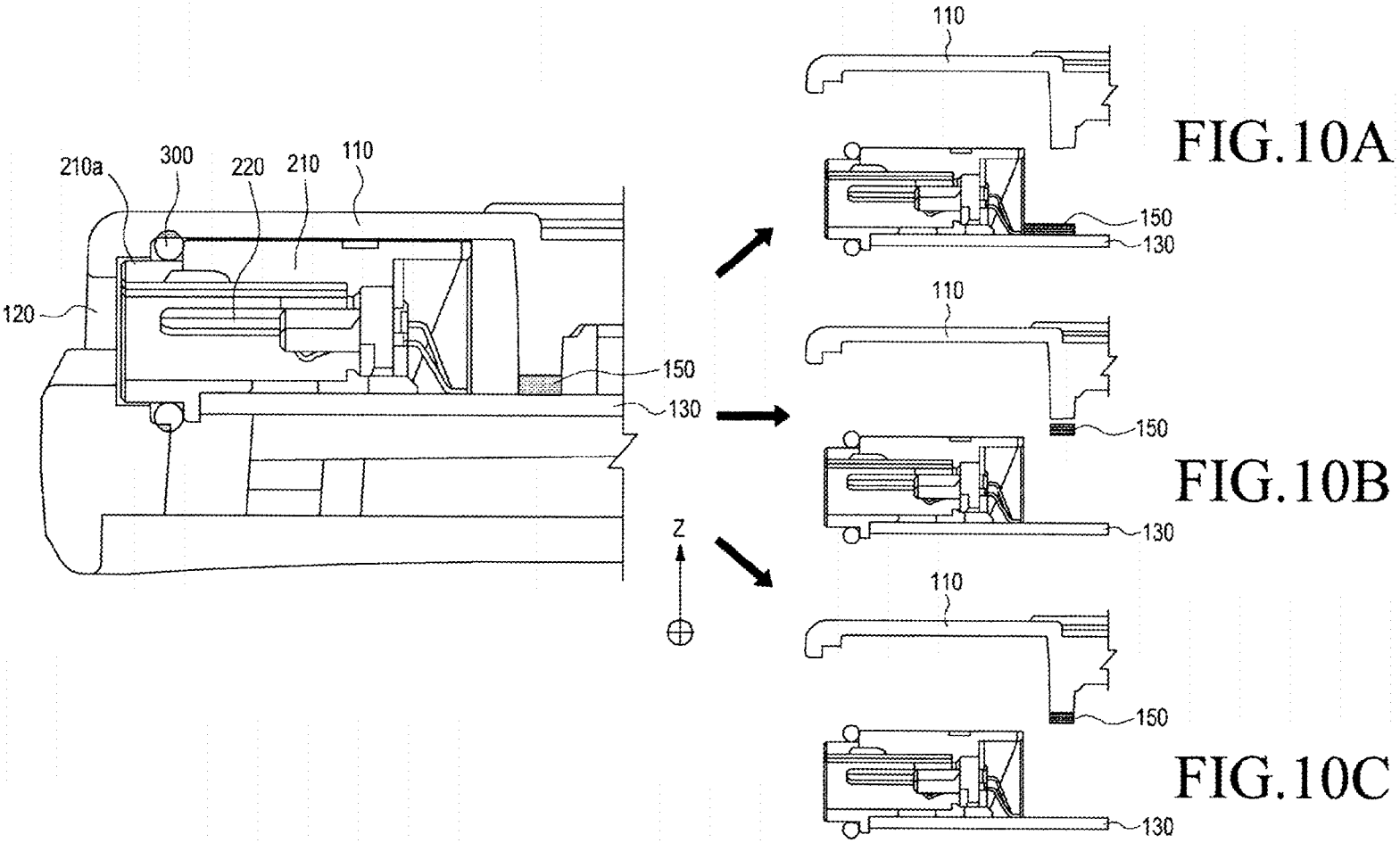
FIG. 10A, FIG. 10B and FIG. 10C are cross-sectional views illustrating a state where a guide member is provided along a coupling line of a connector body and a circuit board in an electronic device including a connector device according to an embodiment of the present disclosure.

FIG. 9 is a view illustrating a state where a guide member is provided along a coupling line of a connector body and a circuit board in an electronic device including a connector device according to one embodiment of the present disclosure. FIG. 10A, FIG. 10B and FIG. 10C are cross-sectional views illustrating a state where a guide member is provided along a coupling line of a connector body and a circuit board in an electronic device including a connector device according to one embodiment of the present disclosure.

Referring to FIGS. 9 and 10A, 10B and 10C, in the state where the connector body 210 is coupled to the circuit board 130, a guide member 150 may be provided around the connector body 210 along the coupling line between the connector body 210 and the circuit board 130. Although not illustrated, the guide member 150 may be a component that protrudes toward the circuit board 130 side on the one face of the case 110 to be formed to the coupling line. In addition, the guide member 150 may be a separate component which is mounted on the one face of the case 110 to protrude toward the circuit board 130 side and to be formed to the coupling line. Since the guide member 150 is formed to protrude from the case 110 to the coupling line of the circuit board 130, a gap generated between the connector body 210 and the circuit board 130 can be sealed, the movement of the connector body 210 in a plane direction on the surface of the circuit board 130 can be limited, and the connector body 210 can be supported. In addition, when the guide member 150 is formed to protrude around the connector body 210, the connector body 210 may be seated within the guide member 150, so that the above-described movement can be prevented, and since external impact can be transferred to the guide member 150 first to be absorbed by the guide member 150, fracturing of the connector device 100 can be prevented and the assemblability can be improved.

In addition, although not illustrated, an additional sealing member may be provided on the guide member 150 so that infiltration of foreign matter to the outside of the guide member 150 can be limited even when the foreign matter is infiltrated through the connector device 100.

According to one embodiment among various embodiments of the present disclosure, the guide member 150 may include at least one of rubber, silicon, sponge, and polyurethane foam, such as Poron.

Figure 11:
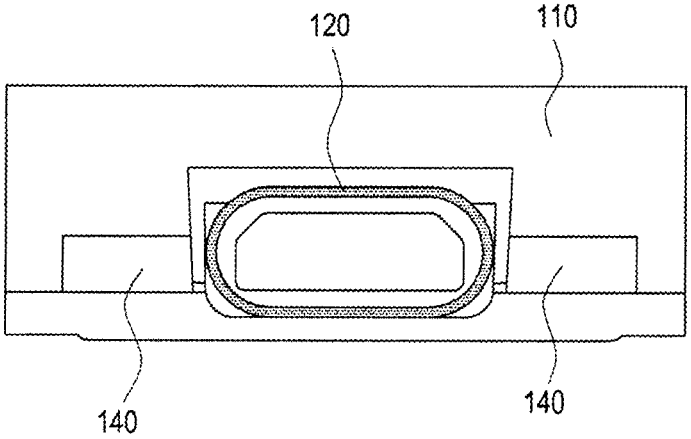
FIG. 11 is a view illustrating a case formed with an opening in an electronic device including a connector device according to an embodiment of the present disclosure.
Figure 12A:
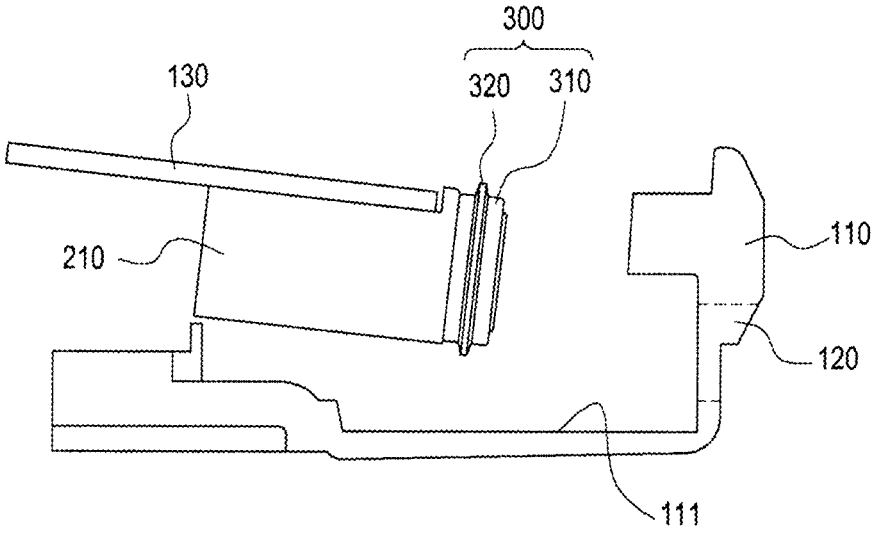
FIG. 12A and FIG. 12B are views illustrating a state in which a connector body is coupled to a case in an electronic device including a connector device according to an embodiment of the present disclosure.
Figure 12B:
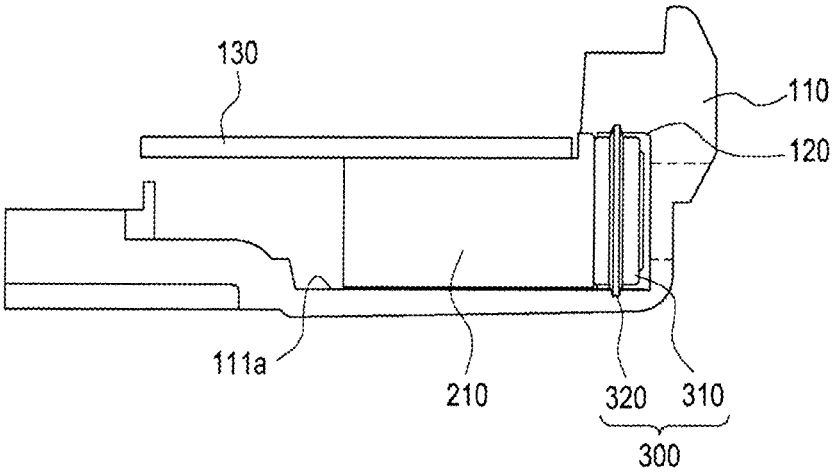

FIG. 11 is a view illustrating a case formed with an opening in an electronic device including a connector device according to one embodiment among various embodiments of the present disclosure. FIGS. 12A and 12B are views illustrating a state in which a connector body is coupled to a case in an electronic device including a connector device according to one embodiment among various embodiments of the present disclosure.

Referring to FIG. 11 and FIGS. 12A and 12B, the case 110 may be a component that forms the exterior face of the electronic device 100, and may be formed as any one of a front case 110 and a rear case 110 of the electronic device 100. The case 110 may be freely changed in terms of, for example, type, configuration, and structure depending on, for example, the kind of the electronic device 100. For example, a bar-type electronic device 100 may include the front and rear cases 110 as described above, and the case 110 according to one embodiment may be formed as any one of the front and rear cases. The case 110 according to one of the present disclosure may be described assuming that it is a rear case 110, as an example. Various modules may be equipped within the case 110, and, for example, a circuit board 130, on which the modules are mounted to be electrically connected, and a bracket (not illustrated), on which a display device is mounted to be supported, may be provided inside the case 110. In addition, the case 110 may be formed with an opening 120 so as to allow that the connector device 200 provided within the case 110 to be connected with an external device.

The opening 120 may be formed through the case 110 so that the external device can be connected to the connector device 200 mounted inside the case 110. In particular, according to one embodiment of the present disclosure, a sealing member 300 to be described later may be mounted in the opening 120 to be in close contact with the inner peripheral face of the opening 120. The opening 120 may be formed at a predetermined position around the case 110. In one embodiment of the present disclosure, the opening 120 may be formed in the periphery of the bottom face of the case 110, for example.

In addition, according to one embodiment of the present disclosure, the opening 120 may be provided as a single part which does not have parting faces divided along the periphery of the case 110. That is, for example, one opening 120 may be formed by coupling a first part, in which one half opening is formed, and a second part, in which another half opening is formed to be opposite to the half opening of the first part. However, in such a case, assembly faces, in which the half openings are engaged, exist in the assembled opening 120. When the assembly faces are generated in the opening 120 as described above, foreign matter may be infiltrated through a gap between the assembly faces. Thus, according to one embodiment of the present disclosure, the opening 120 may be formed as a single part in the periphery of the case 110 so that the assembly faces are not generated. Accordingly, the opening 120 may be formed in the shape of a closed curve-shaped hole without assembly faces therein.

A seating recess 111 may be provided inside the case 110. The seating recess 111 (as shown, for example, in FIG. 12B) is positioned adjacent to the opening 120, and the above-mentioned connector body 210 is mounted in the seating recess. An undercut 111*a* (as shown, for example, in FIG. 12B) may be formed in the seating recess 111. Due to the undercut 111*a* formed in the seating recess 111, the connector body 210 mounted in the seating recess 111 may be mounted in the opening 120 in a press-fit manner. That is, when the connector body 210 is introduced into the seating recess 111 in a slanting state, and the connector body 210 laid in the seating recess 111 is pushed to the opening 120 side, one face of the connector body 210 may be fitted and seated in the opening 120. Then, the one face of the connector body 210 may be pushed in the seating recess 111 by a length corresponding to the undercut 111*a* to be seated in the seating recess 111.

Figure 13:
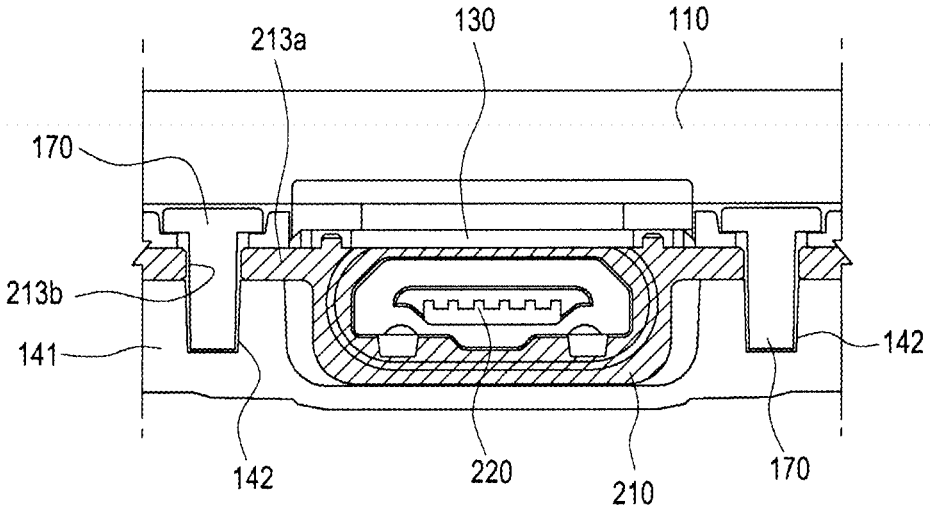
FIG. 13 is a view illustrating a state in which a connector device is fastened to an electronic device in an electronic device including a connector device according to an embodiment of the present disclosure.

FIG. 13 is a view illustrating a state in which a connector device is fastened to an electronic device in an electronic device including a connector device according to one embodiment among various embodiments of the present disclosure, connector device.

Referring to FIG. 13, a fastening part 140, to which the connector body 210 is coupled, may be formed within the case 110.

According to various embodiments of the present disclosure, two embodiments may be considered in terms of the fastening part 140. According to a first embodiment of the present disclosure, the fastening part 140 may be provided as a boss 141 which is in turn formed with fastening holes 142 so that fastening members 170 (see also FIG. 1) can be fastened by penetrating through the connector body 210. In this case, the above-described coupling parts 213 may be formed as coupling plates 213*a* and coupling holes 213*b*. The coupling plates 213*a* may integrally protrude from the connector body 210 to face the boss 141, and the coupling holes 213*b* may be connected with the fastening holes 142. The boss 141 may be provided to be adjacent to the seating recess 111 to protrude toward the connector body 210 from the inner face of the case 110. Thus, when the connector body 210 is laid in the seating recess 111, the coupling parts 213 of the connector body 210, more specifically, the coupling plates 213*a* may be engaged in the state where they are supported on the boss 141, and the coupling holes 213*b* and the fastening holes 142 may be connected with each other. In the state where the connector body 210 is assembled to the case 110 as described above, when the fastening members 170 are fastened to the fastening holes 142 through the coupling holes 213*b*, the connector body 210 is fixed to the case 110.

Figure 14A:
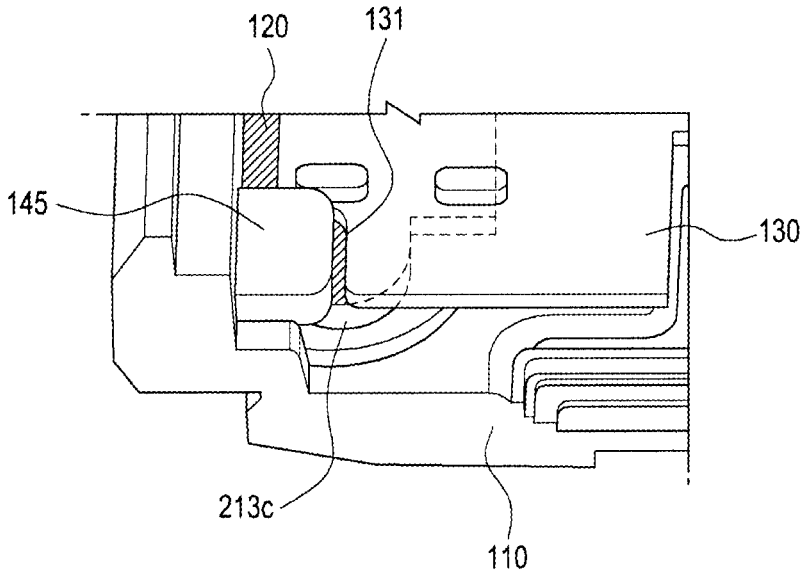
FIG. 14A and FIG. 14B are views illustrating another embodiment of a fastening part in an electronic device including a connector device according to an embodiment of the present disclosure.
Figure 14B:
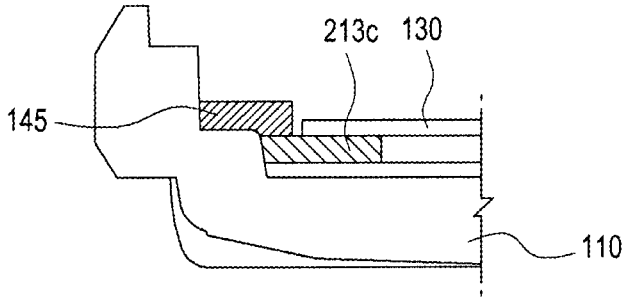

FIGS. 14A and 14B are views illustrating another embodiment of a fastening part in an electronic device including a connector device according to one embodiment among various embodiments of the present disclosure.

Referring to FIGS. 14A and 14B, according to a second embodiment of the present disclosure, the fastening parts 140 may be provided as a protrusion plate 145 that is positioned adjacent to the periphery of the opening 120 and protrudes to a coupling part 213 side of the connector body 210 within the case 110. In this case, the coupling part 213 may be formed as a simple seating plate 213*c* which does not require a configuration, such as a separate hole formed in the connector body 210. A space may be formed between an inner face of the case 110 and the protrusion plate 145. Accordingly, when the connector body 210 is seated in the seating recess 111, the coupling part 213, more specifically, the seating plate 213*c* may be inserted into the space formed between the protrusion plate 145 and the one face of the case 110 and sandwiched therebetween to be fixed. Accordingly, upon being seated in the seating recess 111, the connector body 210 may be engaged with and fixed by the periphery of the seating recess 111 to be prevented from moving leftward and rightward. The connector body 210 may also fixed by the protrusion plate 145 to be prevented from moving in the vertical direction (in the Z-axis direction). Further, as described below, the connector body 210 may be suppressed from moving horizontally leftward and rightward and vertically upward and downward by the guide member 150.

An assembly procedure of the electronic device 100 provided with the connector device 200 as described above will be described. A connector terminal is accommodated in the connector body 210 through metal injection molding and the sealing member 300 may be coupled to the connector body 210 to be in close contact with the sealing face 210*a* in which, for example, a reinforcement structure and a coupling structure are implemented in the connector body 210 as one piece. The connector body 210 may be directly mounted on the circuit board 130 and in the case 110 without assembling a separate shield can or the like. One face of the connector body 210 provided with the sealing member 300 may be mounted on the circuit board 130. At this time, the coupling parts 213 of the connector body 210 may be positioned in the cutout portions 131 of the circuit board 130. Since the cutout portions 131 are provided, the guide member 150 may be mounted along the coupling line between the circuit board 130 and the connector body 210. As a result, the connector body 210 mounted on the circuit board 130 may be sealed in the coupling line by the guide member 150, and the movements of the connector body 210 on the circuit board 130 may be prevented.

The other face of the connector body 210 is inserted into the seating recess 111 of the case 110, and when the connector body 210 inserted into the seating recess 111 is pushed to the opening 120 side, the sealing member 300 may be coupled to be in close contact with the inner face of the opening 120. Thus, the gap between the connector body 210 and the opening 120 can be sealed to block the infiltration of foreign matter.

When the other face of the connector body 120 is seated in the seating recess 111 as one end of the connector body 210 is inserted into the opening 120, the coupling parts 213 may face the fastening parts 140. In the case of the fastening parts 140 and the coupling parts 213 according to the first embodiment among various embodiments of the present disclosure, the boss 141 and the protrusion plate 145 face each other to be supported, and the fastening holes 142 and the coupling holes 213*b* are connected with each other. When the fastening screws are fastened to the fastening holes 142 through the coupling holes 213*b*, the connector body 210 mounted on the circuit board 130 can be coupled to the case 110 to be fixed by the seating recess 111, the fastening part 140, and the coupling parts 213. In addition, in the case of the fastening part 140 and the coupling parts 213 according to the second embodiment among various embodiments of the present disclosure, when the connector body 210 is mounted in the seating recess 111, the connector body 210 can be fixed to be suppressed from moving in the horizontal direction (in the X and Y axis directions) by being inserted into the seating recess 111, and can be fixed to be suppressed from moving in the Z-axis direction as the seating plate 213*c* is inserted into the inner space of the protrusion plate 145.

As described above, since the gap between the opening 120 and the connector body 210 is sealed by the sealing member 300, the infiltration of foreign matter into the space between the connector body 210 and the opening 120 can be prevented primarily.

In addition, since the guide member 150 is further provided between the circuit board 130 and the connector body 210, the infiltration of foreign matter can be sealed again by the guide member 150 even if the foreign matter is infiltrated through the gap between the opening 120 and the connector body 210.

Various embodiments of the present disclosure disclosed in this specification and the drawings are merely specific examples presented in order to easily describe technical details of the present disclosure and to help the understanding of the present disclosure, and are not intended to limit the scope of the present disclosure. Therefore, it should be construed that, in addition to the embodiments disclosed herein, all modifications and changes or modified and changed forms derived from the technical idea of various embodiments of the present disclosure fall within the scope of the present disclosure.

What is claimed is:

1. A connector device for an electronic device comprising:

a connector body that accommodates a connector terminal and is connected with a circuit board, the connector body including a rim;

a sealing member provided in the connector body to seal a gap between the connector body and the electronic device; and a guide member on the rim of the connector body, the guide member supporting the connector body and being disposed along a coupling line between the connector body and the circuit board.

2. The connector device of claim 1, wherein the connector body is provided with a coupling part in one piece with the connector body.

3. The connector device of claim 2, wherein the coupling part is formed to protrude each of opposite sides of the connector body.

4. The connector device of claim 2, wherein the sealing member includes:

an attachment member that is coupled to one end rim of the connector body to enclose and to be in close contact with the one end rim; and a close contact member that protrudes along a peripheral face of the attachment member to be in close contact with the electronic device.

5. The connector device of claim 2, wherein the sealing member includes an O-ring and a sealing face, the O-ring being seated on the sealing face.

6. The connector device of claim 1, wherein the connector body is formed through Metal Injection Molding (MIM).

7. The connector device of claim 1, wherein the guide member sealing a gap between the connector body and the circuit board.

8. The connector device of claim 6, wherein the guide member includes at least one of rubber, silicon, sponge, and polyurethane foam.

9. An electronic device with a connector device, the electronic device comprising:

a case including a main circuit board;

an opening provided in the case and formed as a single part;

a body part including a connector body, the body part being mounted on the main circuit board;

a sealing member that seals a gap between the body part and the opening;

a connector terminal being mounted on a body part inside the case, wherein the connector terminal is exposed outwardly through the opening, and is configured to connect to an external device; and a guide member provided in the case between the circuit board and the body part in a peripheral portion of the body part to support the body part.

10. The electronic device of claim 9, wherein the body part includes a coupling part in one piece with the body part, and the case includes a fastening part that fastens the coupling part.

11. The electronic device of claim 10, wherein the coupling part is formed to protrude each of opposite sides of the connector body.

12. The electronic device of claim 10, wherein the coupling part is formed as a coupling hole, the fastening part is formed as a boss which is provided with a fastening hole, and a fastening member penetrates through the coupling hole and the fastening hole to be screwed thereto.

13. The electronic device of claim 10, wherein the coupling part is formed as a seating plate, the fastening part is provided as a protrusion plate that protrudes within the case to form a space within the case, and the seating plate is inserted into and fixed to the space.

14. The electronic device of claim 10, wherein the main circuit board includes a cutout portion formed to correspond to a position of the coupling part, and the fastening part fixes the body part to the case through the cutout portion.

15. The electronic device of claim 10, wherein a first circuit is provided within the case, the body part is mounted on a second circuit board, and the second circuit board is electrically connected with the main circuit board.

16. The electronic device of claim 15, wherein the second circuit board includes a cutout portion formed to correspond to a position of the coupling part, and the fastening part fixes the body part to the case through the cutout portion.

17. The electronic device of claim 10, wherein the guide member seals a gap between the case and the circuit board.

18. The electronic device of claim 10, wherein the guide member includes at least one of rubber, silicone, sponge, and polyurethane foam.

19. The electronic device of claim 10, wherein the case is provided with a seating recess therein to be connected with the opening, the seating recess including an undercut in which the body part is seated.

20. The electronic device of claim 9, wherein the sealing member includes:

an attachment member that is coupled to one end rim of the connector body to enclose and to be in close contact with the one end rim; and a close contact member that protrudes along a peripheral face of the attachment member to be in close contact with the electronic device.

21. The electronic device of claim 9, wherein the sealing member includes an O-ring and a sealing face, the O-ring being seated on the sealing face.

22. The electronic device of claim 9, wherein the connector body is formed through Metal Injection Molding (MIM).

* * * * *